US009366137B2

(12) United States Patent
Takeda

(10) Patent No.: US 9,366,137 B2
(45) Date of Patent: Jun. 14, 2016

(54) FLUID-PRESSURE APPARATUS WITH GEARS HAVING TOOTH PROFILES

(75) Inventor: Hiroaki Takeda, Hyogo (JP)

(73) Assignee: SUMITOMO Precision Products Co., Ltd., Hyogo (JP)

( * ) Notice: Subject to any disclaimer, the term of this patent is extended or adjusted under 35 U.S.C. 154(b) by 117 days.

(21) Appl. No.: 14/361,589

(22) PCT Filed: Aug. 9, 2012

(86) PCT No.: PCT/JP2012/070337

§ 371 (c)(1),
(2), (4) Date: May 29, 2014

(87) PCT Pub. No.: WO2013/084542

PCT Pub. Date: Jun. 13, 2013

(65) Prior Publication Data

US 2014/0322060 A1 Oct. 30, 2014

(30) Foreign Application Priority Data

Dec. 6, 2011 (JP) ..... 2011-266732

(51) Int. Cl.

| | |
|---|---|
| ***F03C 2/00*** | (2006.01) |
| ***F03C 4/00*** | (2006.01) |
| ***F04C 2/00*** | (2006.01) |
| ***F01C 1/18*** | (2006.01) |
| ***F01C 1/08*** | (2006.01) |

(Continued)

(52) U.S. Cl.

CPC . *F01C 1/18* (2013.01); *F01C 1/084* (2013.01); *F01C 1/16* (2013.01); *F03C 2/08* (2013.01); *F04C 2/084* (2013.01); *F04C 2/16* (2013.01); *F04C 2/18* (2013.01); *F04C 14/28* (2013.01); *F04C 18/084* (2013.01); *F04C 18/16* (2013.01); *F04C 18/18* (2013.01); *F04C 15/0049* (2013.01); *F04C 2270/13* (2013.01)

(58) Field of Classification Search

CPC ..... F04C 2/084; F04C 2/16; F04C 18/084; F04C 18/16; F04C 1/16; F04C 2/18; F04C 18/18; F01C 1/086; F01C 1/16; F01C 1/18; F01C 1/084

USPC ..... 418/201.3, 206.1–206.5, 189–190, 418/201.1

See application file for complete search history.

(56) References Cited

U.S. PATENT DOCUMENTS

| | | | | |
|---|---|---|---|---|
| 5,350,286 A * | 9/1994 | Kisi | ..... | F04C 18/16 418/201.3 |
| 7,232,298 B2 * | 6/2007 | Sundstrom | ..... | F04C 18/16 418/201.3 |
| 8,556,609 B2 | 10/2013 | Morselli | | |

FOREIGN PATENT DOCUMENTS

| | | |
|---|---|---|
| EP | 0211127 | 2/1987 |
| GB | 574364 | 1/1946 |

(Continued)

OTHER PUBLICATIONS

Search Report for related European Application No. EP 12855423; report dated Jul. 7, 2015.

*Primary Examiner* — Theresa Trieu

(74) *Attorney, Agent, or Firm* — Miller, Matthias & Hull LLP

(57) ABSTRACT

A pair of meshed gears is disposed in a hydraulic chamber of a housing. Bushes in the chamber contact both end surfaces of the gears. Edge surfaces of the gears are chamfered at intermediate parts between tooth tips and tooth bottoms, and the inclination of the intermediate parts is larger than those of the tooth tips and bottom, thereby protecting the edges from damage due to contact force as the gears mesh and preventing leakage between the gears and the support members. Accordingly, the gears may be operated quietly, at high output efficiency, and increased reliability for an extended period.

12 Claims, 9 Drawing Sheets

(51) Int. Cl.

| | |
|---|---|
| ***F04C 2/16*** | (2006.01) |
| ***F01C 1/16*** | (2006.01) |
| ***F04C 18/18*** | (2006.01) |
| ***F04C 18/16*** | (2006.01) |
| ***F04C 18/08*** | (2006.01) |
| ***F04C 2/18*** | (2006.01) |
| ***F04C 2/08*** | (2006.01) |
| ***F03C 2/08*** | (2006.01) |
| ***F04C 14/28*** | (2006.01) |
| *F04C 15/00* | (2006.01) |

(56) References Cited

FOREIGN PATENT DOCUMENTS

| | | |
|---|---|---|
| GB | 1584020 | 2/1981 |
| JP | 51070504 | 6/1976 |
| JP | 51109401 | 9/1976 |
| JP | 2003083259 | 3/2003 |
| JP | 2008215382 | 9/2008 |
| WO | 2009098773 A1 | 8/2009 |

* cited by examiner

FIG. 3
| | Theoretical discharge flow rate (L/min) | Actual discharge flow rate (L/min) | | | | |
|---|---|---|---|---|---|---|
| | | Initial | 50 hrs. later | 100 hrs. later | 150 hrs. later | 200 hrs. later |
| Example | 114.3 | 107.4 | 107 | 106.5 | 107 | 107 |
| Comparative Example 1 | 114.3 | 109 | 107 | 105.2 | 104.2 | 103 |
| Comparative Example 2 | 114.3 | 95.5 | 95.2 | 95 | 95 | 94.5 |
FIG. 4
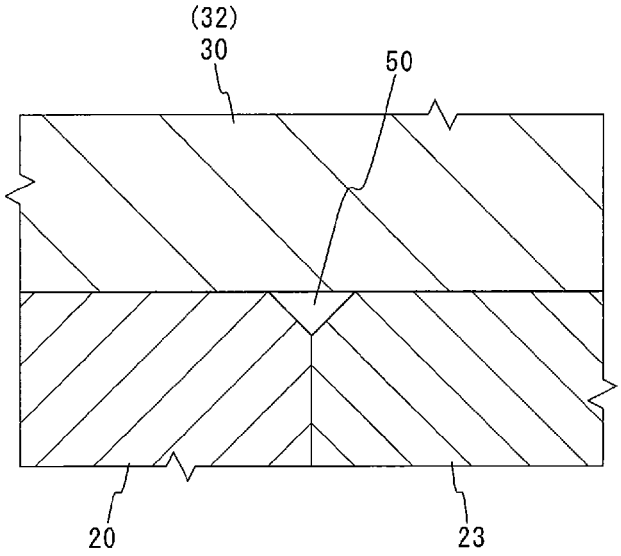
FIG. 5
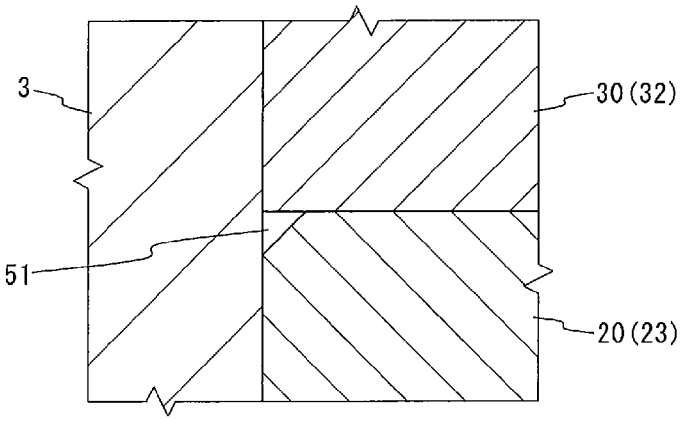

FLUID-PRESSURE APPARATUS WITH GEARS HAVING TOOTH PROFILES

CROSS-REFERENCE TO RELATED APPLICATIONS

This application is a U.S. National Stage filing under 35 USC §371 of International Patent Application No. PCT/JP2013/070337 filed on Aug. 9, 2013. This application also claims priority under the Paris Convention to Japanese Application No. 2011-266732, filed on Dec. 6, 2011.

TECHNICAL FIELD

The present invention relates to a fluid-pressure apparatus having a pair of gears whose tooth surfaces mesh with each other.

BACKGROUND ART

As a fluid-pressure apparatus as mentioned above, a hydraulic pump which rotates a pair of gears by an appropriate drive motor and pressurizes an operation fluid by the rotational motions of the gears and discharges the pressurized operation fluid, and a hydraulic motor which rotates gears by introducing a previously pressurized operation fluid therein and uses rotational forces of rotating shafts of the gears as a power are conventionally known.

Such fluid-pressure apparatuses have a problem of operational noise generated by meshing of gears, a problem of noise generated by discontinuous change of the volume of the liquid confined between tooth surfaces of the meshing gears, and the like. In order to reduced such noise, conventionally a fluid-pressure apparatus using a pair of gears having a theoretical tooth profile which prevents the occurrence of a gap between tooth surfaces of the gears meshing with each other has been suggested (see the Unexamined Patent Application (Translation of PCT Application) Publication No. 2010-521610).

FIGS. 8 to 11 show the fluid-pressure apparatus disclosed in the Unexamined Patent Application (Translation of PCT Application) Publication No. 2010-521610, specifically, an oil hydraulic device. It is noted that, although the Unexamined Patent Application (Translation of PCT Application) Publication No. 2010-521610 does not disclose the whole configuration of the oil hydraulic device, FIGS. 8 and 9 shows also the whole configuration thereof.

As shown in FIGS. 8 and 9, an oil hydraulic device 1 has a housing 2 having a hydraulic chamber 4 formed therein, a pair of helical gears 20', 23' (hereinafter, simply referred to as "gears") inserted in the hydraulic chamber 4 in a state where their tooth portions mesh with each other, and bushes 30, 32 as two support members which are inserted in the hydraulic chamber 4 in a state of being in contact with both end surfaces of the pair of gears 20', 23' to support the pair of gears 20', 23'.

The housing 2 comprises a body 3 in which the hydraulic chamber 4 having a space with a substantially 8-shaped cross-section is formed from one end surface to the other end surface thereof, a first flange 8 screwed on the one end surface of the body 3, and a second flange 11 similarly screwed on the other end surface of the body 3, and the hydraulic chamber 4 is closed by the first flange 8 and the second flange 11.

One of the pair of gears 20', 23' is a driving gear 20' and the other is a driven gear 23'. The gears 20', 23' respectively have rotating shafts 21, 24 which are respectively provided to extend in the axial directions of the gears 20', 23' from both end surfaces of the gears 20', 23', and the rotating shaft 21 of the gear 20' has a tapered portion formed on one end portion thereof and a screw portion 22 is formed on the tip of the tapered portion. Further, the pair of gears 20', 23' are, as described above, contained in the hydraulic chamber 4 in a state of meshing with each other, and the outer surfaces of their tooth tips are in sliding contact with an inner peripheral surface 7 of the hydraulic chamber 4.

The bushes 30, 32 are metal bearings comprising a plate-shaped member having a substantially 8-shaped cross-section and respectively have two support holes 31, 33, and the rotating shafts 21, 24 of the gears 20', 23' are inserted through the support holes 31, 33, and thereby the rotating shafts 21, 24 are supported to be rotatable. Further, the bushes 30, 32 are inserted in the hydraulic chamber 4 in a state where the rotating shafts 21, 24 of the gears 20', 23' are inserted through the support holes 31, 33 and end surfaces of the bushes 30, 32 are in contact with the end surfaces of the gears 20', 23'. It is noted that the other end surfaces of the bushes 30, 32 are in contact with of end surfaces of the first flange 8 and the second flange 11, respectively, and thereby movement of the gears 20', 23' and the bushes 30, 32 in their axial directions is restricted.

Further, the first flange 8 has an insertion hole 9 formed through which the rotating shaft 21 having the screw portion 22 of the driving gear 20' is inserted, and the driving gear 20' is arranged in the hydraulic chamber 4 in a state where the rotating shaft 21 is inserted through the insertion hole 9 of the first flange 8 and extended to the outside. Further, an oil seal 10 is provided in the insertion hole 9 and the oil seal 10 provides sealing between the insertion hole 9 and the rotating shaft 21. It is noted that O-rings 12 are respectively interposed between the end surfaces of the body 3 and the first and second flanges 8, 11, and the O-rings 12 provide sealing therebetween.

Further, the body 3 has an intake port (intake flow path) 5, which leads to the hydraulic chamber 4, bored in one side surface thereof and a discharge port (discharge flow path) 6, which similarly leads to the hydraulic chamber 4, bored in another side surface thereof located opposite said side surface with the hydraulic chamber 4 between them. Further, the intake port 5 and the discharge port 6 are provided so that their axes are positioned at the middle between the rotating shafts 21, 24 of the pair of gears 20', 23'.

The pair of gears 20', 23' has such a theoretical tooth profile that their tooth surfaces are continuously and linearly in contact with each other in the axial direction of the rotating shafts 21, 24 and tooth tips of one of them are brought into contact with tooth bottoms of the other of them as shown in FIGS. 10 and 11. Thus, due to the contact between the gears 20' and 23', the hydraulic chamber 4 is divided in two, a high-pressure side and a low-pressure side, with the contact portion 26 as a border. The bushes 30, 32 being in contact with the end surfaces of the gears 20', 23' have a function of preventing leakage of the operation fluid from the high-pressure side to the low-pressure side by the contact between the gears 20' and 23', and therefore, in the oil hydraulic device 1, the roundness or inclination of edges of the end surfaces of the tooth portions of the gears 20', 23' is set to be as small as possible.

The oil hydraulic device 1 having the above-described configuration can be used as an oil hydraulic pump or an oil hydraulic motor. For example, in a case where it is used as an oil hydraulic pump, appropriate piping which is connected to an appropriate tank for storing an operation fluid therein is connected to the intake port 5 of the housing 2, and the rotating shaft 21 of the driving gear 20' is driven by an appropriate drive motor, thereby rotating the driving gear 20' in the direction indicated by the arrow R shown in FIG. 11.

Thereby, the driven gear 23' meshing with the driving gear 20' is rotated in the direction indicated by the arrow R', the operation fluid in a space 28 between the inner peripheral surface 7 of the hydraulic chamber 4 and the tooth portions of the gears 20', 23' is transferred to the discharge port 6 side by the rotation of the gears 20', 23', and the discharge port 6 side is brought into a high pressure and the intake port 5 side is brought into a low pressure, with the contact portion 26 between the pair of gears 20', 23' as a border.

When the intake port 5 side is brought into a negative pressure in the above-described manner, the operation fluid in the tank is inhaled into the low-pressure side of the hydraulic chamber 4 through the piping and the intake port 5, and is transferred to the discharge port 6 side by the operation of the pair of gears 20', 23' and thereby pressurized to a high pressure, and the pressurized operation fluid is discharged through the discharge port 6.

In the above-described manner, the oil hydraulic device 1 functions as an oil hydraulic pump.

Further, according to this oil hydraulic device 1, since, as described above, the pair of gears 20', 23' have such a theoretical tooth profile that their tooth surfaces are continuously and linearly in contact with each other in the axial direction of the rotating shafts 21, 24 and the tooth tips of one of them are brought into contact with the tooth bottoms of the other, the above-mentioned noise problems can be solved. Further, since the roundness or inclination of the edges of the end surfaces of the tooth portions is set to be as small as possible and thereby the sealability between the end surfaces of the gears and the end surfaces of the bushes is improved, thereby preventing leakage of the operation fluid from the high-pressure discharge port 6 side to the low-pressure intake port 5 side, high discharge volume (which is volume efficiency and also output efficiency) can be obtained.

SUMMARY OF THE DISCLOSURE

However, while the above-described conventional oil hydraulic device 1 has, as described above, a merit that the noise problems can be solved and high volume efficiency can be obtained, it has a problem that, since the roundness or inclination of the edges of the end surfaces of the tooth portions is set to be as small as possible for obtaining high volume efficiency, when the pair of gears 20', 23' mesh with each other, contact stress tends to concentrate at the edges and the edges are easily damaged due to the contact stress. Particularly, intermediate parts between the teeth tips and the tooth bottoms are regions having a function of transmitting power from the driving gear 20' to the driven gear 23', and because a larger stress acts thereon than on the tooth tips and the tooth bottoms, the intermediate parts are easily damaged. Further, in a case where the pair of gears 20', 23' are helical gears like the oil hydraulic device 1, as shown in FIG. 10, the edges have portions where the angle is acute (acute angle portions) 27*a*' and portions where the angle is obtuse (obtuse angle portions) 27*b*', and, of these portions, particularly the acute angle portions 27*a*' are easily damaged. FIG. 12 shows a state where edge portions are damaged as described above. It is noted that the damaged portions are indicated by the reference C.

Further, if, for example, an edge portion is broken as described above, a problem that a broken piece caused by the breaking bites the pair of gears 20', 23' meshing with each other and the tooth surfaces thereof at the biting portion is damaged, that is, the damaged region is expanded is caused, and, in turn, a large abnormal noise occurs or the oil hydraulic device 1 can be brought into a disabled state. Furthermore, it is conceivable that the broken piece caused by the breaking is transferred from the oil hydraulic device 1 to an oil hydraulic equipment connected thereto and the oil hydraulic equipment is damaged by the broken piece.

Further, in a case where an edge portion is broken, the sealability between the edges and the bushes 30, 32 is reduced, and therefore a problem that the discharge amount of the operation fluid is reduced, that is, volume efficiency is lowered, is caused. This problem is explained with reference to FIGS. 13 to 15. It is noted that FIGS. 13 and 15 are sectional views showing a state where the bush 30 (32) is in contact with the end surfaces of the gears 20', 23', and FIG. 13 shows a case where the edges are not broken and FIG. 15 shows a case where an edge portion is broken. Further, FIG. 14 is a sectional view showing a portion where the gear 20' (23') is in contact with the bush 30 (32) and the inner peripheral surface 7 of the body 3, and shows a case where the edge is not broken.

As shown in FIGS. 13 and 14, in the case where the edges are not broken, since the roundness or inclination of the edges is set to be as small as possible, a gap 40 between the edges of the gears 20', 23' and the bush 30 (32) and a gap 41 between the edge portion of the gear 20' (23'), the body 3 and the bush 30 (32) is very small, and further viscous resistance acts between the edges of the gears 20', 23', the bush 30 (32) and the body 3. Therefore, leakage of the operation fluid through the gaps 40, 41 between the high-pressure side and the low-pressure side hardly occurs.

On the other hand, if, for example, an edge portion of the gear 20' is broken as shown in FIG. 15, a gap 40' between the edges of the gears 20', 23' and the bush 30 (32) is large, and, as for the operation fluid in the vicinity of the edges and the bush 30, viscous resistance acts between the operation fluid and the edges and between the operation fluid and the bush 30, whereas, as for the operation fluid away from the edge portions and the bush 30, such viscous resistance does not act. Therefore, movement of the operation fluid through the gap 40' easily occurs and leakage of the operation fluid from the high-pressure side to the low-pressure side occurs.

Thus, the above-described conventional oil hydraulic device 1 has a structural problem that a rated discharge amount cannot be maintained for a long time, and a problem that the device lacks reliability.

The present invention has been achieved in view of the above-described circumstances and an object thereof is to provide a conventional fluid-pressure apparatus which is quiet and has high output efficiency, the apparatus being capable of maintaining the quietness and the output efficiency for a long time, and having higher reliability than before.

Solution to Problem

The present invention, for solving the above-described problems, relates to a fluid-pressure apparatus comprising:

a pair of gears which each have a tooth portion formed at an outer peripheral portion thereof and the tooth portions of which mesh with each other;

a housing which has a hydraulic chamber in which the pair of gears are contained in a state of meshing with each other, the hydraulic chamber having an arc-shaped inner peripheral surface with which outer surfaces of tooth tips of the pair of gears are in sliding contact;

support members which are inserted in the hydraulic chamber of the housing in a state of being respectively in contact with both end surfaces of the gears and support rotating shafts respectively provided to extend outward from both end surfaces of the gears;

the housing having an intake flow path and a discharge flow path which respectively open in one side inner surface and another side inner surface of the hydraulic chamber with the pair of gears between them; and the pair of gears having such a theoretical tooth profile that their tooth surfaces are continuously and linearly in contact with each other in an axial direction of the rotating shafts and the tooth tips of one of the gears are brought into contact with tooth bottoms of the other of the gears, wherein on edges of the end surfaces of the tooth portions of the gears, at least intermediate parts between the tooth tips and the tooth bottoms are chamfered and the intermediate parts have a roundness or inclination larger than those of the tooth tips and the tooth bottoms.

According to the present invention, on the edges of the end surfaces of the tooth portions of the pair of gears, at least the intermediate parts between the tooth tips and tooth bottoms are chamfered and the roundness or inclination of the intermediate parts is larger than those of the tooth tips and the tooth bottoms.

Thus, by chamfering at least the intermediate parts between the tooth tips and the tooth bottoms, the edge strength of the intermediate parts can be increased, thereby preventing the intermediate parts from being damaged due to contact stress generated when the pair of gears mesh with each other. Although a larger stress acts on the intermediate parts, particularly a power transmitting region, than on other portions, increasing the strength thereof by chamfering makes it possible to improve the durability thereof. On the other hand, because the tooth tips and the tooth bottoms are not a power transmitting region and the stress acting thereon is not so large, even if the roundness or inclination of their edge portions is made small, there is not a fear that they are damaged.

Further, in the present invention, by making the roundness or inclination of the tooth tips and the tooth bottoms smaller than that of the intermediate parts, the sealability between the end surfaces of the gears and the support members is maintained.

That is, although, if the entire edges of the tooth portions are uniformly chamfered to prevent the occurrence of damage of the edges, leakage from the high-pressure side to the low-pressure side occurs similarly to the above-described case where an edge portion is broken, such leakage can be prevented by making at least the tooth tips and the tooth bottoms have such a roundness or slop that the leakage does not occur.

As described above, the roundness or inclination of the edges of the tooth potions causes mutually contradictory phenomena that, when it is small, although the sealablity is improved, the strength is reduced and the edges are easily damaged, and that, on the other hand, when it is large, although the strength is increased and the edges are hardly damaged, the sealability is reduced and leakage easily occurs.

The inventor of the present application, as a result of eager studies, found out that it is possible to achieve both the sealabily and the strength by making the tooth tips and the tooth bottoms have a very small roundness or inclination which does not cause the leakage and making the intermediate parts have a roundness or slop which does not cause the damage.

Further, according to the present invention, it is possible to provide a lubricating effect between the end surfaces of the gears and the support members by chamfering the intermediate parts.

As described above, according to the fluid-pressure apparatus of the present invention, the original performance of being quiet and having high output efficiency can be maintained for a long time and higher reliability than before can be obtained.

Further, in the present invention, it is particularly preferable that edge portions corresponding to the power transmitting region (hereinafter, referred to as "power-transmitting-region portions") are chamfered. As described above, since particularly large stress acts on the power-transmitting-region portions, chamfering the portions can prevent damage thereof.

It is noted that the "power-transmitting-region portion" means a theoretical curve portion which is represented by theoretical curves used in general gears, such as an involute curve and a trochoid curve, specifically a theoretical curve portion which is arranged in the vicinity of a pitch point of the gears and cannot be expressed by one perfect circle (single R). The power-transmitting-region portion is generally positioned in a range of 0.1 h to 0.9 h from the tooth bottom, where h is the tooth depth of the gears. Further, in the present invention, it is particularly preferable that the intermediate part is positioned in a range of 0.26 h to 0.81 h from the tooth bottom.

Further, in the present invention, the pair of gears may be helical gears, and in this case, the chamfering may be performed on only the intermediate parts on a side where the angle between the end surface of the gear and the tooth surface is acute.

The strength of the acute-angle edge portions is lower than that of the obtuse-angle edge portions, and, although there is no fear of damage to the obtuse-angle edge portions, risk of damage to the acute-angle edge portions is high. Therefore, by chamfering the acute-angle edge portions, risk of damage can be reduced for the entire edges. Further, by suppressing the part to be chamfered to minimum, the sealability between the edges and the support members can be maintained more appropriately.

Further, in the present invention, it is preferable that the width of chamfering performed on the intermediate parts is between 0.05 and 0.8 mm, and it is more preferable that it is between 0.1 and 0.2 mm. It is noted that the "depth of chamfering" here means, in a case where the chamfering is round, the chord length dimension of the arc portion, and means, in a case where the chamfering is a inclination, the width of the inclination.

Advantageous Effects of Invention

As described in detail above, according to the fluid-pressure apparatus of the present invention, since, on the edges of the end surfaces of the tooth portions of the gears, at least the intermediate parts between the tooth tips and the tooth bottoms are chamfered and the roundness or inclination of the intermediate parts is made larger than those of the tooth tips and the tooth bottoms, it is possible to prevent the edges from being damaged due to contact force generated when the pair of gears mesh with each other, and it is possible to prevent leakage of the operation fluid through between the gears and the support members. Thereby, the original performance of being quiet and having high output efficiency can be maintained for a long time and higher reliability than before can be obtained.

BRIEF DESCRIPTION OF DRAWINGS

FIG. 3 is a table indicating results of a performance degradation experiment of an oil hydraulic device;

FIG. 4 is a sectional view of a contact portion between a pair of gears and a bush, for explaining an effect of the present invention;

FIG. 5 is a sectional view of a contact portion between a gear, a bush and a body, for explaining the effect of the present invention;

DETAILED DESCRIPTION

Hereinafter, in connection with a fluid-pressure apparatus according to a specific embodiment of the present invention, as an example, an oil hydraulic device using a hydraulic oil as operation fluid will be described with reference to FIGS. 1 to 7. It is noted that the oil hydraulic device according to this embodiment has, instead of the pair of helical gears 20', 23' of the conventional oil hydraulic device 1 shown in FIGS. 8 to 11, a similar pair of helical gears 20, 23 edges of end surfaces of which are chamfered, and, other than that, the configuration thereof is the same as that of the conventional oil hydraulic device 1. Therefore, detailed explanation of the same components as those of the conventional oil hydraulic device 1 is omitted.

Figure 1:
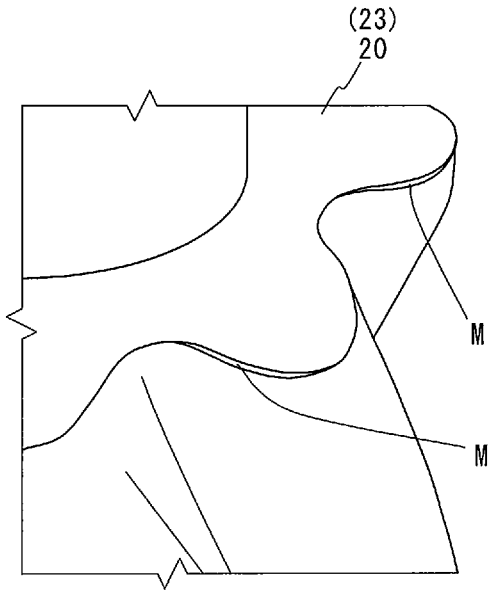
FIG. 1 is a perspective view showing a state where edge portions of an end surface of a gear is chamfered.

In the pair of helical gears 20, 23 of the oil hydraulic device according to the present embodiment, on the edges of the end surfaces of the gears 20, 23, only edge portions where the angle between the end surface and the tooth surface is acute (an acute angle portion 27*a* shown in FIG. 2, corresponding to the acute angle portion 27*a*' shown in FIG. 10) are chamfered, and the width of chamfering is varied from the tooth tip to the tooth bottom and the width of chamfering of the intermediate part is larger than those of the tooth tip and the tooth bottom (see FIG. 1). This is specifically explained with reference to FIG. 2. It is noted that a chamfered portion is indicated by the reference M.

Figure 2:
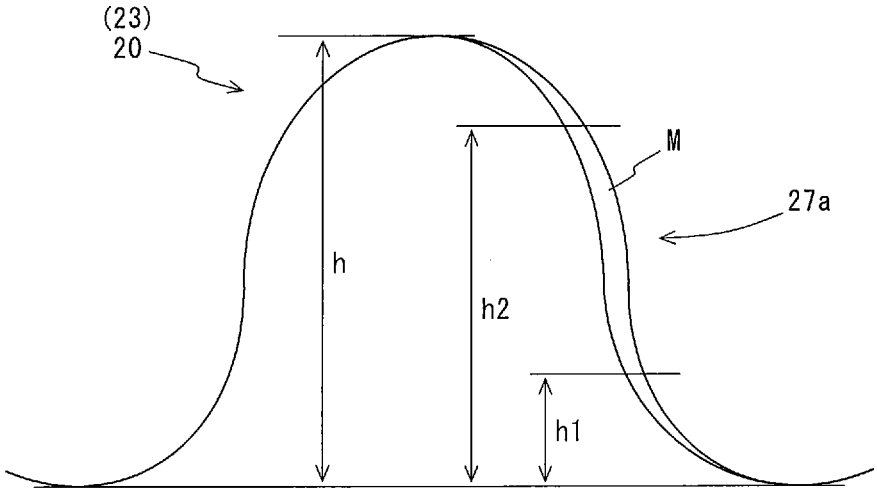
FIG. 2 is a schematic diagram for explaining a method of determining a width of chamfering of an edge portion of an end surface of a gear.

FIG. 2 is a schematic diagram for explaining a method of determining the width of chamfering of an edge portion of an end surface of the gears 20, 23. It is noted that h in FIG. 2 indicates the tooth depth of the tooth portion. In a case where: the portion from the tooth bottom to h1 is defined as a tooth bottom part; the portion from h1 to h2 is defined as an intermediate part; the portion from h2 to the tooth tip is defined as a tooth tip part; and a predetermined maximum depth of chamfering is set, the tooth bottom part is chamfered so that the width of chamfering is gradually increased from 0 to the maximum width of chamfering starting from the tooth bottom to h1, the intermediate part is chamfered so that the width of chamfering of the entire part is the maximum width of chamfering, and the tooth tip part is chamfered so that the width of chamfering is gradually decreased from the maximum width of chamfering to 0 starting from h2 to the tooth tip.

Here, it is preferable that the values of h1 and h2 are set so that the power-transmitting-region portion is included between h1 and h2, and h1 is from 0.1 h to 0.5 h (positioned at 10 to 50% of the tooth depth from the tooth bottom) and h2 is from 0.5 h to 0.9 h (portioned at 50 to 90% of the tooth depth from the tooth bottom). In other words, it is preferable that the intermediate part is set within a range of 0.1 h to 0.9 h, and as a more preferable example, an example in which h1=0.26 h and h2=0.81 h can be given.

It is noted that, although, in the foregoing, the widths of chamfering of the tooth tip part and the tooth bottom part are 0, in actual machining, it is very difficult to set the width of chamfering to 0. Therefore, it is allowed to make the tooth tip part and the tooth bottom part have such a width of chamfering that an acceptable degree of leakage from the high-pressure side to the low-pressure side occurs.

Further, the width of chamfering of the intermediate part does not have to be uniform and may be gradually changed. In brief, it is important to make the intermediate part have such a width of chamfering that the intermediate part can obtain a predetermined strength. In this sense, it is preferable that the width of chamfering of the intermediate part is from 0.05 to 0.8 mm, and it is more preferable that it is from 0.1 to 0.2 mm.

In the oil hydraulic device of the present embodiment having the above-described configuration, since the width of chamfering of the intermediate parts of the acute angle portions 27 which are easily damaged when the gears 20, 23 mesh with each other is set to be larger than those of the tooth tips and the tooth bottoms of the edges, the strength of the intermediate parts are increased and the durability thereof is improved. Therefore, when using this oil hydraulic device as an oil hydraulic pump or an oil hydraulic motor, even if contact stress concentrates at the intermediate parts due to meshing of the pair of gears, the intermediate parts are prevented from being damaged or broken, and it is possible to remarkably improve the durability thereof as compared with the conventional oil hydraulic device.

On the other hand, since the widths of chamfering of the tooth tip part and the tooth bottom part are set to 0 or such a width of chamfering that leakage from the high-pressure side to the low-pressure side is within an acceptable range, similarly to the conventional oil hydraulic device 1, it is possible to secure high sealability between the end surfaces of the gears 20, 23 and the end surfaces of the bushes 30, 32, and it is possible to secure high output efficiency.

Figure 6:
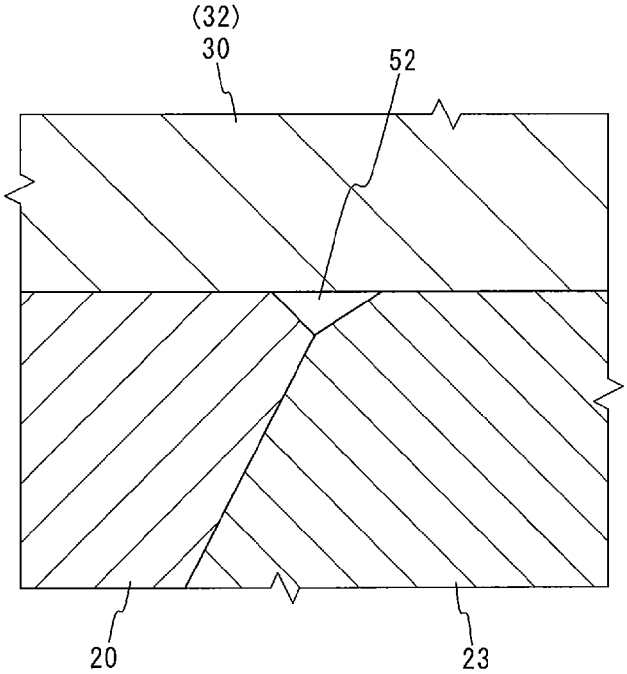
FIG. 6 is a sectional view of a contact portion between the pair of gears and the bush, for explaining the effect of the present invention.

That is, if the entire edges of the gears 20, 23 are chamfered, as shown in FIGS. 4 and 6, large gaps 50, 52 are generated between the gears 20, 23 and the bush 30 (32) at a portion where a tooth tip part and a tooth bottom part of the gears 20, 23 mesh with each other and a portion where the intermediate parts of the gears 20, 23 mesh with each other, respectively, and the operation fluid leaks through the gaps 50, 52. Further, similarly, as shown in FIG. 5, a large gap 51 is generated between the gear 20 (23), the body 3 and the bush 30 (32), and the operation fluid leaks through the gap 51. Therefore, in this case, while the strength of the edges can be increased, leakage of the operation fluid occurs on the entire edges and therefore there is a problem that high sealability cannot be secured.

It is noted that FIG. 4 is a sectional view of a portion where a tooth tip part and a tooth bottom part of the gears 20, 23 mesh with each other and FIG. 6 is a sectional view of a portion where the intermediate parts of the gears 20, 23 mesh with each other. Further, FIG. 5 is a sectional view of a portion where the gear 20 (23) is in contact with the body 3 and the bush 30 (32).

Figure 13:
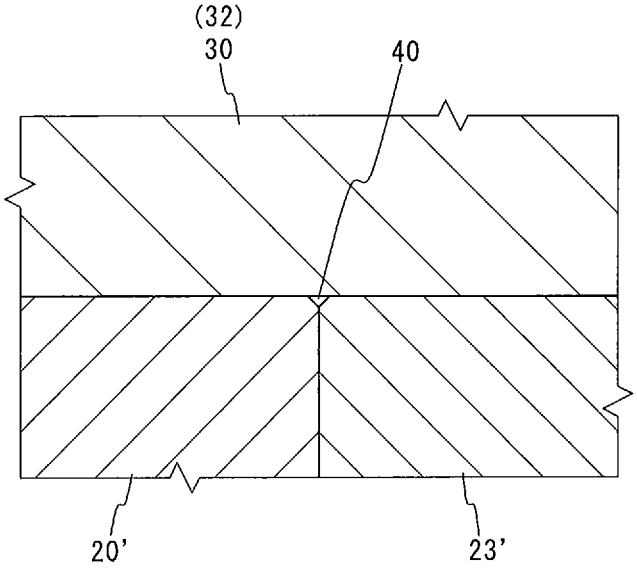
FIG. 13 PRIOR ART
FIG. 13 is a sectional view of a contact portion between a pair of gears and a bush in the conventional oil hydraulic device.
Figure 14:
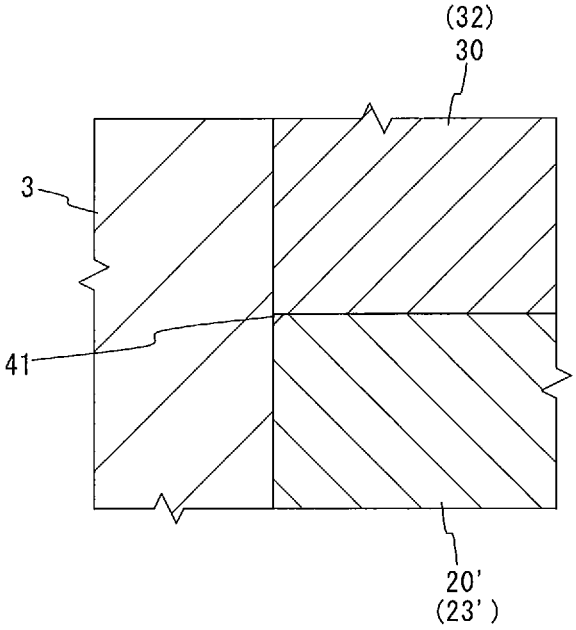
FIG. 14 PRIOR ART
FIG. 14 is a sectional view of a contact portion between a gear, a bush and a body in the conventional oil hydraulic device.
Figure 15:
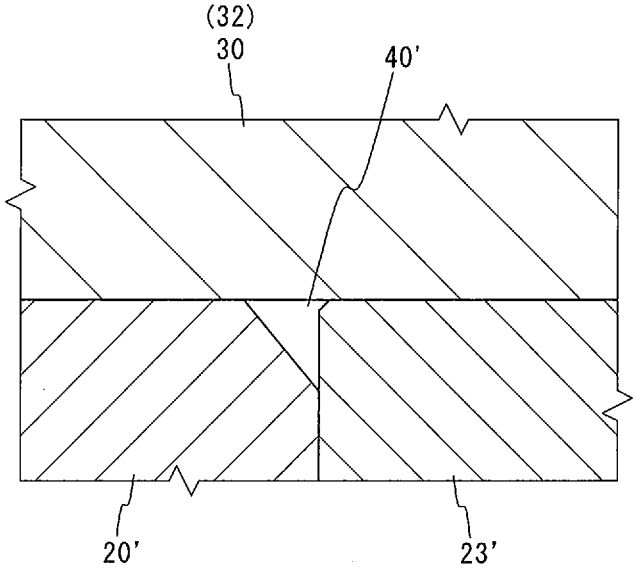
FIG. 15 PRIOR ART
FIG. 15 is a sectional view of a contact portion between a pair of gears and a bush, for explaining a problem in the conventional oil hydraulic device.

To the contrary, in the oil hydraulic device according to the present embodiment, as described above, the widths of chamfering of the tooth tip part and the tooth bottom part on which high stress does not act are set to 0 or set to such a width of chamfering that leakage from the high-pressure side to the low-pressure side is within an acceptable range. Therefore, as seen from FIGS. 13 and 14, at the tooth tip parts and the tooth bottom parts, a gap between the gears 20, 23 and the bush 30 (32) and a gap between the gear 20 (23), the body 3 and the bush 30 (32) are very small, and, even if the leakage occurs, it can be suppressed within an acceptable range.

Figure 7:
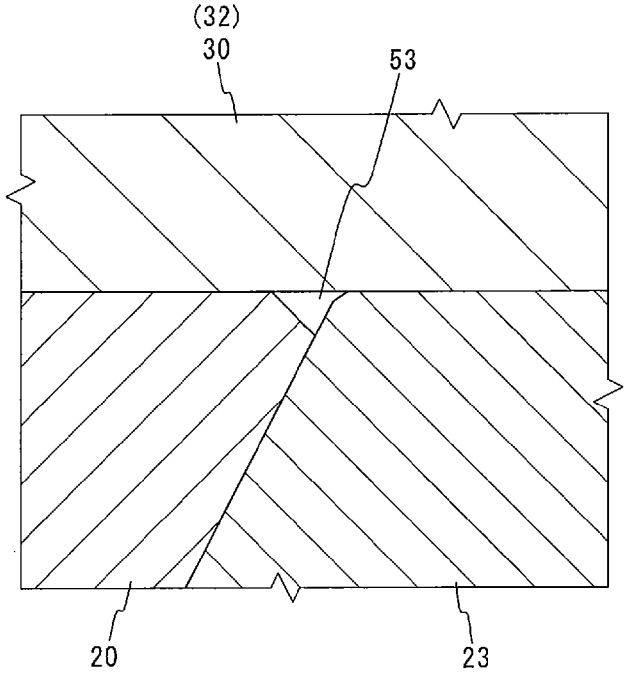
FIG. 7 is a sectional view of a contact portion between the pair of gears and the bush, for explaining the effect of the present invention.
Figure 8:
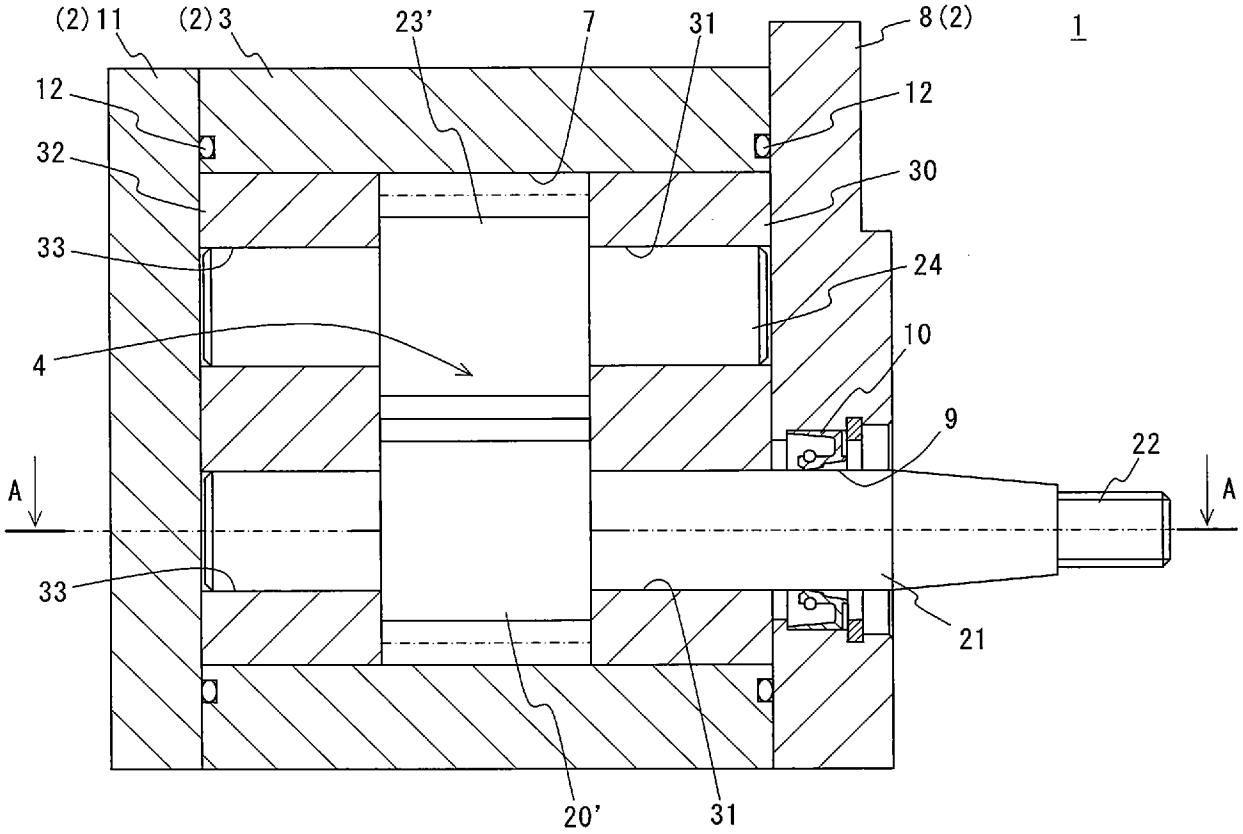
FIG. 8 PRIOR ART
FIG. 8 is a sectional view showing a configuration a conventional oil hydraulic device.
Figure 9:
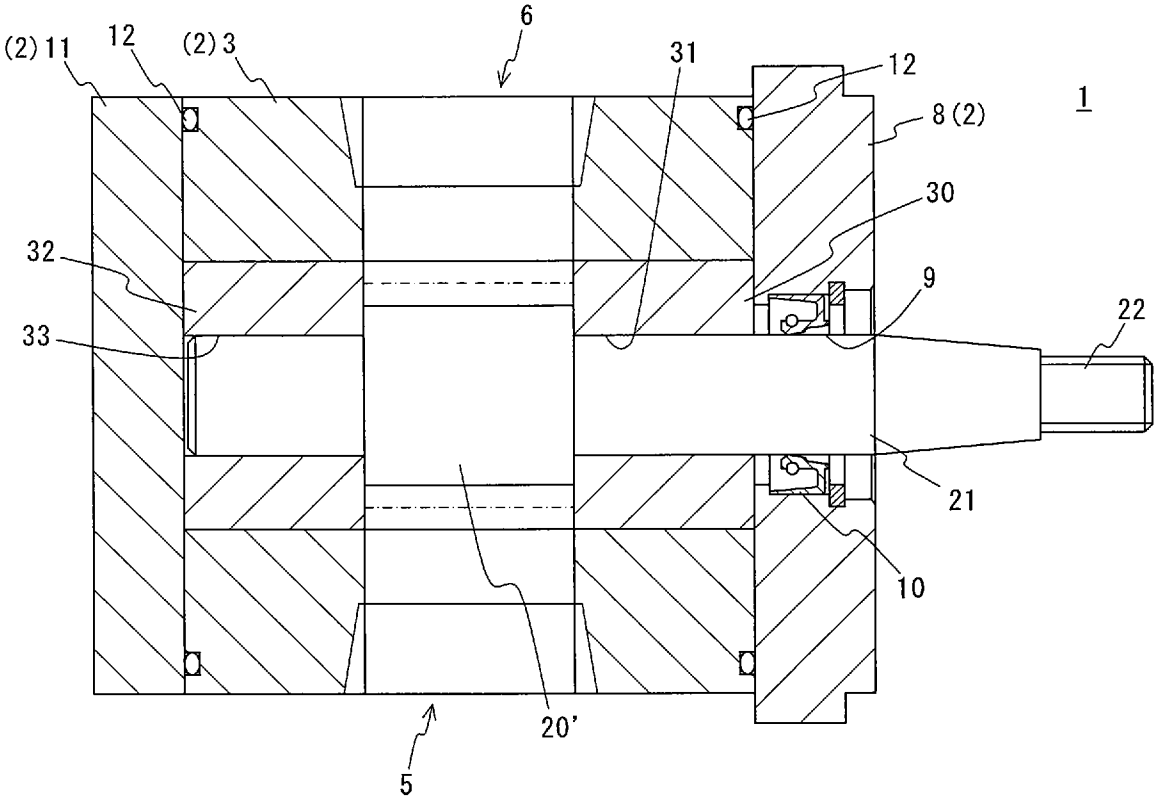
FIG. 9 PRIOR ART
FIG. 9 is a sectional view taken along A-A in FIG. 8.
Figure 10:
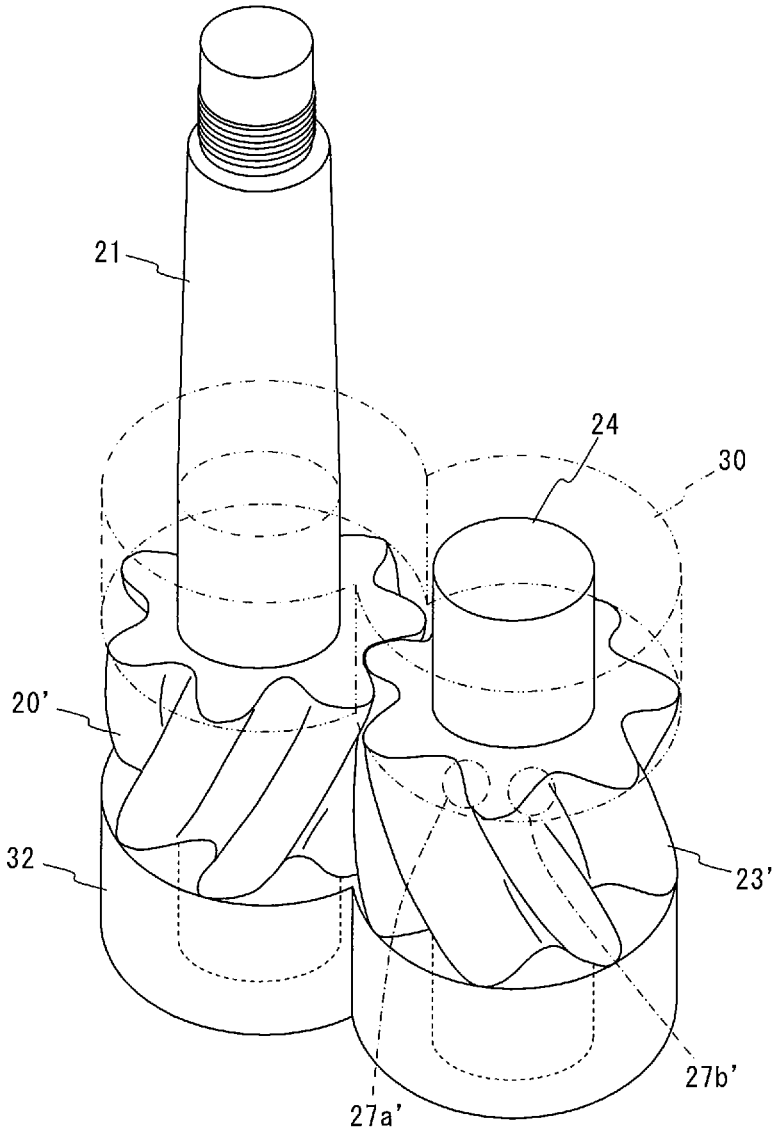
FIG. 10 PRIOR ART
FIG. 10 is a perspective view showing a state where buses are in contact with end surfaces of a pair of gears meshing with each other.
Figure 11:
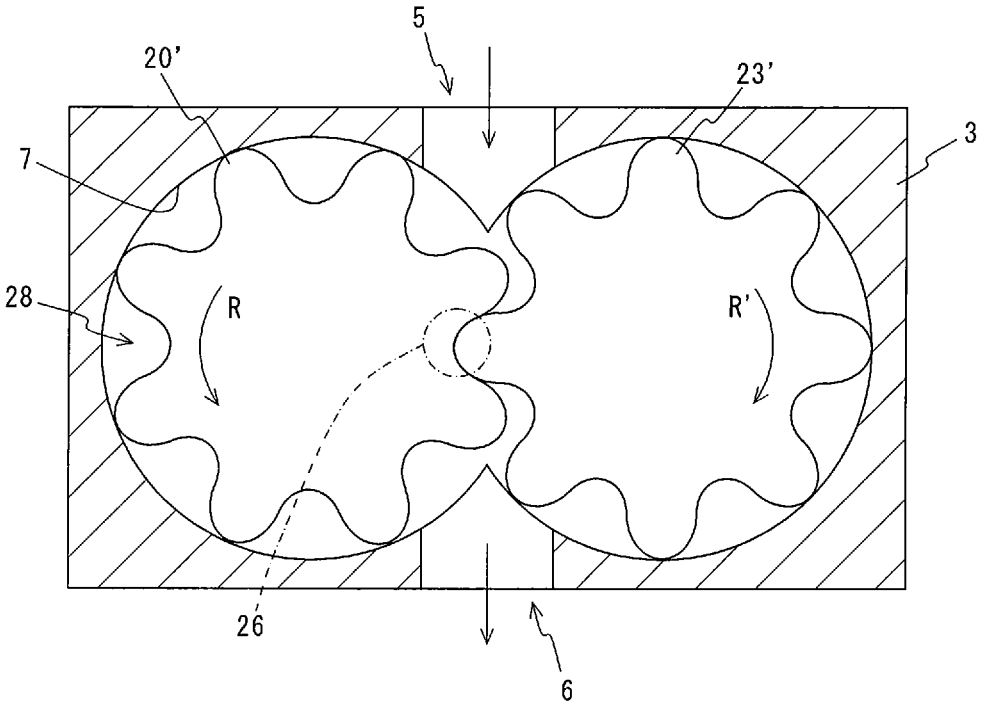
FIG. 11 PRIOR ART
FIG. 11 is a plane view showing a state where helical gears mesh with each other.
Figure 12:
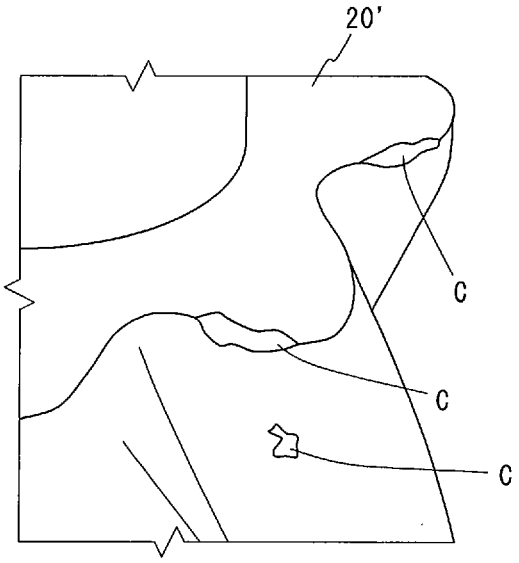
FIG. 12 PRIOR ART
FIG. 12 is a perspective view showing a state where edge portions of an end surface and a tooth surface of a gear are broken.

Further, since predetermined chamfering is performed on only the intermediate parts of the acute angle portions 27*a* which are easily broken when the gears 20, 23 mesh with each other, as shown in FIG. 7, although a gap 53 generated between the gears 20, 23 and the bush 30 (32) is larger as compared with a case where chamfering is not performed thereon, it is smaller than the gap 52 shown in FIG. 6. Therefore, the amount of leakage is reduced for that. It is noted that FIG. 7 is a sectional view of a portion where the intermediate parts mesh with each other in a case where chamfering is performed on only the intermediate parts of the acute angle portions 27.

Thus, according to the oil hydraulic device of the present embodiment, for the above-described reasons, an effect that the durability is high and high output efficiency can be maintained for a long time as compared with the conventional oil hydraulic device 1 is achieved.

EXAMPLE

In this connection, the inventor of the present application performed a performance comparison experiment using an oil hydraulic pump corresponding to the conventional oil hydraulic device 1 using helical gears the edges of the tooth portions of which are not chamfered (Comparative Example 1), an oil hydraulic pump using helical gears the entire edges of the tooth portions of which are chamfered (Comparative Example 2) and an oil hydraulic pump using helical gears only the acute-angle edge portions of the tooth portions of which are chamfered so that the width of chamfering of the intermediate part between tooth tip part and the tooth bottom part is larger than those of the tooth tip part and the tooth bottom part (Example). The results thereof are described below. It is noted that FIG. 3 is a table which indicates the results obtained when the above-mentioned oil hydraulic pumps were driven and the discharge flow rates thereof were measured at a predetermined time interval.

As shown in FIG. 3, the oil hydraulic pumps of the Example, the Comparative Example 1 and the Comparative Example 2 have the same theoretical discharge flow rate. In the Example, the initial discharge flow rate measured was 107.4 L/min (94% of the theoretical value), and, the discharge flow rate measured after 200 hours had elapsed was almost the same, that is, 107 L/min. On the other hand, in the Comparative Example 1, although the initial discharge flow rate measured was 109 L/min (95.4% of the theoretical value), thereafter, the discharge flow rate was reduced as time elapsed, and, after 200 hours had elapsed, the discharge flow rate was 103 L/min (90.1% of the theoretical value) and the discharge flow rate has been reduced by 2.8% as compared with the initial discharge flow rate. Further, in the Comparative Example 2, although the initial discharge flow rate was 95.5 L/min (83.6% of the theoretical value), which was low as compared with the Example and the Comparative Example 1, the discharge flow rate thereof was not reduced with elapse of time like the Example and the discharge flow rate after 200 hours had elapsed was 94.5 L/min (82.7% of the theoretical value).

As described above, in the oil hydraulic pump of the Example, the initial discharge flow rate is 94% of the theoretical value, and therefore it has a high discharge flow rate (that is, high volume efficiency) equivalent to that of the conventional oil hydraulic device 1 (the Comparative Example 1). This means that volume efficiency is not affected even when the intermediate parts are chamfered.

On the other hand, in the Comparative Example 2 in which the entire edges were chamfered, the obtained initial discharge flow rate was only 83.6% of the theoretical value. This indicates that, when the tooth tip parts and the tooth bottom parts of the edge portions are chamfered, the leakage becomes extremely large and the volume efficiency thereof is remarkably lowered.

Further, in the Example and the Comparative Example 2, the discharge flow rate was not changed so much even after the operation time has elapsed. This indicates that, since chamfering the edges of the tooth portions increases the strength of the edges and therefore the edges are hardly damaged, the seability between the end surfaces of the gears and the end surfaces of the bushes is preferably maintained even after the operation time has elapsed.

On the other hand, in the Comparative Example 1 in which the edges were not chamfered, the discharge flow rate was reduced as time elapsed, and, after 200 hours have elapsed, the discharge flow rate has been reduced by 2.8% as compared with the initial discharge flow rate. In a case where the edges are not chamfered, the edges are easily broken, and, in view of the foregoing, it is seen that the edges are broken with elapse of time, and thereby the sealability between the end surfaces of the gears and the end surfaces of the bushes is reduced and the leakage is increased.

Thus, according to the oil hydraulic pump of the Example, it is possible to obtain high volume efficiency and maintain it for a long time.

As described in detail above, in the oil hydraulic pump of the present embodiment, since only the acute-angle edge portions of the end surfaces of the tooth portions of the pair of helical gears are chamfered so that the intermediate parts thereof have a larger width of chamfering than those of the tooth tip parts and the tooth bottom parts, it is possible to increase the strength of the intermediate parts and prevent the intermediate parts from being broken. Further, such chamfering makes it possible to secure high volume efficiency equivalent to that of the conventional oil hydraulic device 1 and maintain the high volume efficiency for a long time, thereby improving the durability as compared with the conventional oil hydraulic device 1 and obtaining high reliability.

It is noted that, although, as described above, except for the fact that the edges of the end surfaces of the pair of helical gears 20, 23 are chamfered, the oil hydraulic device according to the present embodiment has the same configuration as that of the conventional oil hydraulic device 1 shown in FIGS. 8 to 11, a specific mode in which the present invention can be realized is not limited thereto.

For example, although, in the above embodiment, the fluid-pressure apparatus according to the present invention was embodied as an oil hydraulic pump as an example, it is not limited thereto and may be an oil hydraulic motor, for example. Further, the operation fluid is not limited to the hydraulic oil, and coolant may be used as operation fluid, for example. In this case, the fluid-pressure apparatus according to the present invention is embodied as a coolant pump.

Further, the oil hydraulic device of the above embodiment has the configuration in which a pair of helical gears are used, the configuration thereof is not limited thereto and the oil hydraulic device may have a configuration in which a pair of spur gears are used. In this case, one or both of the edges of the end surfaces of the tooth portions can be chamfered.

Further, although the oil hydraulic device of the above embodiment has the configuration in which the buses 30, 32 are directly in contact with the gears 20, 23, it may have a configuration in which plate-shaped sliding members (for example, side plates) are respectively interposed between the bushes 30, 32 and the gears 20, 23. Furthermore, each of the bushes 30, 32 may be divided in two and both sides of the rotating shafts 21, 24 may be individually supported by the four bushes.

Further, a configuration may be employed in which a key groove is formed in the tapered portion of the rotating shaft 21 and a key is inserted in the key groove, and an appropriate rotary body is coupled to the tapered portion of the rotating shaft 21 by the key groove and the key.

Further, although, in the above embodiment, the intake port 5 and the discharge port 6 are bored as through holes in the body, the intake hole 5 and the discharge hole 6 may be anything as long as they lead to the hydraulic chamber 4. Therefore, the intake port 5 and the discharge port 6 may be formed in the body, the first flange 8 and/or the second flange 11 to form flow paths (an intake flow path and a discharge flow path) one ends of which lead to the hydraulic chamber 4 though an opening formed in the body 3 and the other ends of which lead to the outside through an opening formed in the first flange 8 and/or the second flange 11.

The invention claimed is:

1. A fluid-pressure apparatus comprising:

a pair of gears which each have a tooth portion formed at an outer peripheral portion of the gear and the tooth portions of which mesh with each other;

a housing which has a hydraulic chamber in which the pair of gears are contained in a state of meshing with each other, the hydraulic chamber having an arc-shaped inner peripheral surface with which outer surfaces of tooth tips of the pair of gears are in sliding contact;

support members which are inserted in the hydraulic chamber of the housing in a state of being respectively in contact with both end surfaces of the gears and support rotating shafts respectively provided to extend outward from both end surfaces of the gears;

the housing having an intake flow path and a discharge flow path which respectively open in one side inner surface and another side inner surface of the hydraulic chamber with the pair of gears between them; and the pair of gears comprising helical gears having an identical theoretical tooth profile such that their tooth surfaces are continuously and linearly in contact with each other in an axial direction of the rotating shafts and the tooth tips of one of the gears are brought into contact with tooth bottoms of the other of the gears, wherein the pair of gears have chamfering performed on at least edges of the end surfaces of the tooth portions positioned on a side where an angle between the end surface of the tooth portion and the tooth surface is acute, and corresponding to at least intermediate parts which are a power-transmitting region portion between the tooth tips and the tooth bottoms, a roundness or inclination of the chamfering of the edges of the intermediate parts is larger than a roundness or inclination at the edges of the tooth tips and a roundness or inclination at the edges of the tooth bottoms, and a width of the chamfering performed on the edges of the intermediate parts is from 0.05 to 0.8 mm.

2. The fluid-pressure apparatus according to claim 1, wherein the chamfering is performed on only the edges of the intermediate parts positioned on the side where the angle between the end surface of the tooth portion and the tooth surface is acute.

3. The fluid-pressure apparatus according to claim 1, wherein the intermediate part is within a range of 0.1 h to 0.9 h from the tooth bottom, where h is a tooth depth of the gears.

4. The fluid-pressure apparatus according to claim 3, wherein the chamfering is performed on only the edges the intermediate parts positioned on the side where the angle between the end surface of the tooth portion and the tooth surface is acute.

5. The fluid-pressure apparatus according to claim 1, wherein the intermediate part is within a range of 0.26 h to 0.81 h from the tooth bottom, where h is a tooth depth of the gears.

6. The fluid-pressure apparatus according to claim 5, wherein the chamfering is performed on only the edges of the intermediate parts positioned on the side where the angle between the end surface of the tooth portion and the tooth surface is acute.

7. The fluid-pressure apparatus according to claim 1, wherein a width of the chamfering performed on the edges of the intermediate parts is from 0.1 to 0.2 mm.

8. The fluid-pressure apparatus according to claim 7, wherein the chamfering is performed on only the edges of the intermediate parts positioned on the side where the angle between the end surface of the tooth portion and the tooth surface is acute.

9. The fluid-pressure apparatus according to claim 7, wherein the intermediate part is within a range of 0.1 h to 0.9 h from the tooth bottom, where h is a tooth depth of the gears.

10. The fluid-pressure apparatus according to claim 9, wherein the chamfering is performed on only the edges of the intermediate parts positioned on the side where the angle between the end surface of the tooth portion and the tooth surface is acute.

11. The fluid-pressure apparatus according to claim 7, wherein the intermediate part is within a range of 0.26 h to 0.81 h from the tooth bottom, where h is a tooth depth of the gears.

12. The fluid-pressure apparatus according to claim 11, wherein the chamfering is performed on only the edges of the intermediate parts positioned on the side where the angle between the end surface of the tooth portion and the tooth surface is acute.

* * * * *